United States Patent [19]

Smith et al.

[11] Patent Number: 4,702,471

[45] Date of Patent: Oct. 27, 1987

[54] ARTICLE TRANSPORT ARRANGEMENT

[75] Inventors: David A. Smith, Midland; Herbert B. Geiger, Bay City, both of Mich.

[73] Assignee: The Dow Chemical Company, Midland, Mich.

[21] Appl. No.: 812,485

[22] Filed: Dec. 23, 1985

[51] Int. Cl.[4] ..... B65H 29/32

[52] U.S. Cl. ..... 271/284; 271/186; 271/197; 271/310

[58] Field of Search ..... 271/310, 183, 194, 196, 271/197, 276, 186, 283, 284, 299, 279, 280

[56] References Cited

U.S. PATENT DOCUMENTS

| | | | |
|---|---|---|---|
| 2,352,983 | 7/1944 | Trump . | |
| 3,291,282 | 12/1966 | Pedagno | 271/197 X |
| 3,659,840 | 5/1972 | Ruck | 271/197 X |
| 3,796,424 | 3/1974 | Fox | 271/197 X |
| 3,805,683 | 4/1974 | Hook | 271/197 X |
| 3,863,730 | 8/1972 | Driessen | 271/299 X |
| 3,947,020 | 3/1976 | Kobayashi | 271/197 X |
| 4,027,870 | 6/1977 | Frech | 271/186 X |
| 4,260,147 | 4/1981 | Houle | 271/186 X |
| 4,270,879 | 6/1981 | Kacirek | 271/197 X |
| 4,358,466 | 11/1982 | Stevenson | 426/106 |
| 4,526,360 | 7/1985 | Focke | 271/284 X |
| 4,555,013 | 11/1985 | Franklin | 271/197 X |

*Primary Examiner*—Richard A. Schacher

*Attorney, Agent, or Firm*—L. E. Hessenaur, Jr.

[57] ABSTRACT

An article transport arrangement for conveying articles along a pair of generally parallel transport paths from a first location to a second location includes a pair of vacuum belt conveyors which extend between the first and second locations, generally above the transport paths. A vacuum arrangement for applying a suction force to the articles in excess of that applied to the articles by the vacuum belt conveyors is positioned opposite the vacuum belt conveyors so as to ingest articles through a pair of collection openings.

9 Claims, 8 Drawing Figures

ARTICLE TRANSPORT ARRANGEMENT

BACKGROUND OF THE INVENTION

The present invention relates to article transport equipment and, more particularly, equipment which conveys generally flat, flexible web products along a product path, removes the products from the path, and stacks the products.

Various article transport equipment has been devised in the past to convey, and stack flexible web products, such as for example plastic food bags. One such plastic bag of this type is shown in U.S. Pat. No. 4,358,466, issued Nov. 9, 1982, to Stevenson. The bag includes a zipper locking mechanism and, additionally, includes wing-shaped pouch portions.

In one type of bag fabricating equipment, two parallel streams of bags are produced, conveyed along a pair of generally parallel transport paths by a pair of vacuum belt conveyors, engaged by grippers carried on a rotary support, termed an inverter roll, and removed from the path. The articles are then deposited on a support surface by the inverter roll where they are stacked prior to being packaged.

From time to time, the bags produced by the fabricating equipment and supplied to the article transport equipment will not be suitable for packaging, but rather must be collected separately. This may occur, for example, at start-up of the fabricating equipment. At other times, only the bags in one transport path are defective and must be collected, while the bags in the other path are handled and packaged in the usual fashion.

It is desirable, therefore, to be able to cull bags from both transport paths or from only one path while permitting the bags transported in the adjacent parallel path to be packaged in a normal manner. Further, the bag transports typically include vacuum belt conveyor arrangements, and it is desirable that the removal of bags from one path be accomplished without altering the operation of the belt conveyor with respect to the other path.

It is seen, therefore, that there is a need for an arrangement for selectively removing articles from either or both of a pair of vacuum belt conveyors without altering the operation of the conveyors.

SUMMARY OF THE INVENTION

This need is met by the article transport arrangement of the present invention which conveys articles along a pair of generally parallel transport paths from a first location to a second location. The arrangement includes a pair of vacuum belt conveyors extending from the first location to the second location above the transport paths, and inverter roll means, adjacent the transport paths at the second location, for receiving articles and stacking the articles in two piles beneath the vacuum belt conveyors. A vacuum means, positioned between the inverter roll and the first location beneath the transport path, removes articles selectively from either or both of the vacuum belt conveyors.

The vacuum means may comprise a pair of vacuum chambers to which a partial vacuum is supplied, means defining a pair of collection openings positioned adjacent respective transport paths opposite the vacuum belt conveyors, and means for supplying a partial vacuum to the vacuum chambers. Each collection opening communicates with a respective one of the pair of vacuum chambers. Articles may be ingested through the openings into the chambers from either or both of the vacuum belt conveyors.

The partial vacuum supplied to the vacuum chambers applies a force to the articles through the collection openings in excess of the force applied to the articles by the pair of vacuum belt conveyors, whereby the articles are removed from the transport arrangement without altering operation of the vacuum belt conveyors.

The means defining a pair of collection openings may comprise a pair of generally upwardly extending chutes, defining the collection openings at their upper ends and extending downward to the vacuum chambers. The means defining a pair of collection openings may further comprise a pair of guide plates, each extending from one of the collection openings generally toward the first location, whereby passage of the articles over the vacuum means is facilitated. Each of the guide plates may be inclined downward from the edge of the collection opening and each of the collection openings may extend substantially completely across the transport path associated therewith.

Accordingly, it is an object of the present invention to provide an article transport arrangement which permits selective removal of articles from either or both of a pair of vacuum belt conveyors; to provide such an arrangement in which a vacuum means applies a suction force to the articles in excess of that applied by the vacuum belt conveyors, so as to remove the articles selectively from either or both of the transport paths; and to provide such an arrangement in which the articles are ingested into vacuum chambers through collection openings positioned adjacent respective transport paths opposite the vacuum belt conveyors.

Other objects and advantages of the invention will be apparent from the following description, the accompanying drawings and the appended claims.

DETAILED DESCRIPTION OF THE PREFERRED EMBODIMENT

Reference is made to FIGS. 1–4 in which the frame of an article transport and handling apparatus is seen to include side frames 10 and 10'. Side frame 10 has been removed from FIG. 1 for purpose of clarity.

Figure 1:
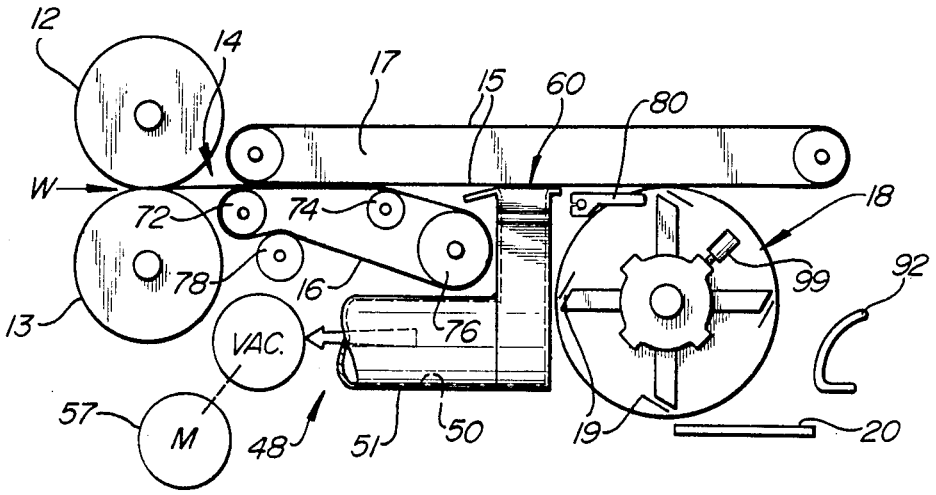
FIG. 1 is a side elevational view with one side frame removed, partly schematic, illustrating apparatus according to the present invention.
Figures 1A, 1B, 1C, 1D:
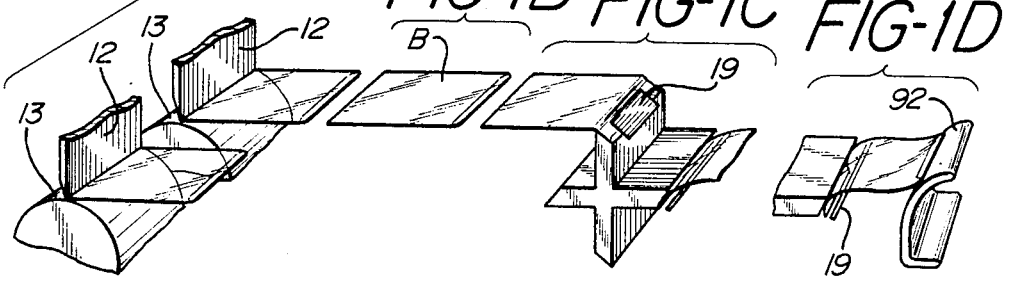
FIGS. 1A through 1D are schematic perspective views of a sequence of steps performed by the apparatus of FIG. 1.

The overall function of the apparatus may be best understood by reference to FIGS. 1A–1D. Two parallel streams of web products, such as plastic bags B, are formed by the bag fabricating equipment by cutting a pair of webs with knife rolls 12, operating against anvil rolls 13. For purposes of clarity, FIGS. 1B–1D depict the handling of a single stream of the bags as they are conveyed along a single transport path, it being understood that identical steps occur with respect to the other stream as it moves along a substantially parallel transport path.

After a bag is formed, it enters a conveyor at a first location generally designated 14. The conveyor includes upper belts 15 and lower belts 16 which together define a pair of parallel transport paths. The belts 15 and 16 are preferably operated at a faster speed than the speed of the web entering the cut-off station. This results in the bags being spaced apart as shown in FIG. 1B. The upper belts 15 are vacuum belts made of screen-type material which run under vacuum boxes or manifolds 17. Lower belts 16 extend around rollers 72, 74, and 76, and tensioning roller 78.

The bags are delivered to an inverter roll, generally designated 18, which includes a plurality of grippers 19. The grippers sequentially grip the bags in the transport path and move the bags in sequence around an arcuate path for deposit on a stacking surface 20. After a predetermined number of bags have been deposited on the surface 20, an appropriate detector receiving the output of rotation sensor 99 actuates a stack transport device which removes the stack of bags from surface 20 and packages the stack. The bags removed from the two transport paths by the first gripping means 18 are transported downward by the grippers and are stacked in a pair of stacks on stacking surfaces 20. A guide 92 assists in depositing each bag smoothly on the surfaces 20.

Not infrequently, it happens that the bags supplied to the first location 14 for transport along the pair of generally parallel transport paths to the inverter roll 18 at a second location are defective in some respect, giving rise to the need to separate or cull these bags from the bags which are to be packaged. The culled bags may be collected for reuse of the material from which the bags are made.

Figure 2:
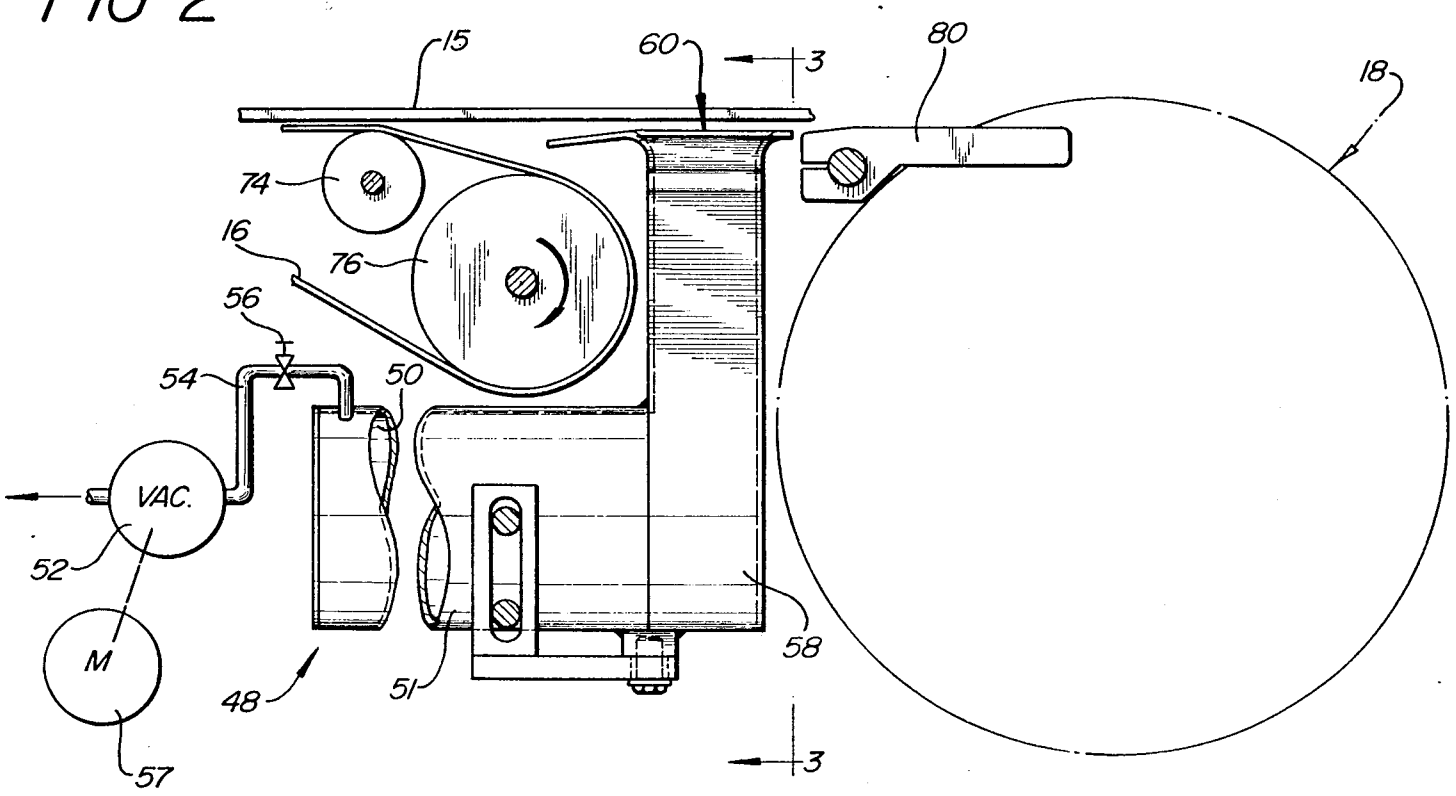
FIG. 2 is an enlarged elevational view, similar to FIG. 1, but illustrating in greater detail the vacuum means for removing articles from the vacuum belt conveyors.
Figure 3:
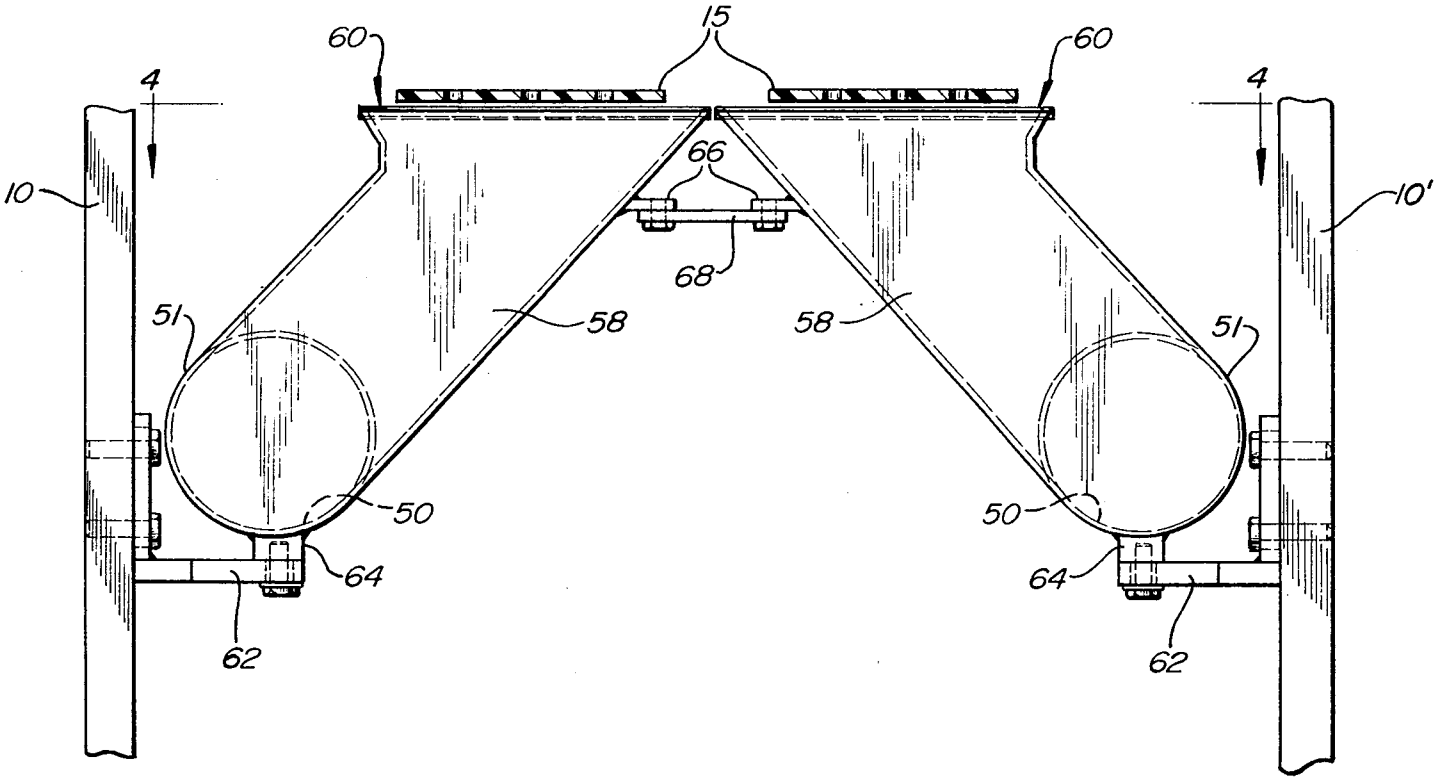
FIG. 3 is a view taken generally along line 3—3 in FIG. 2.
Figure 4:
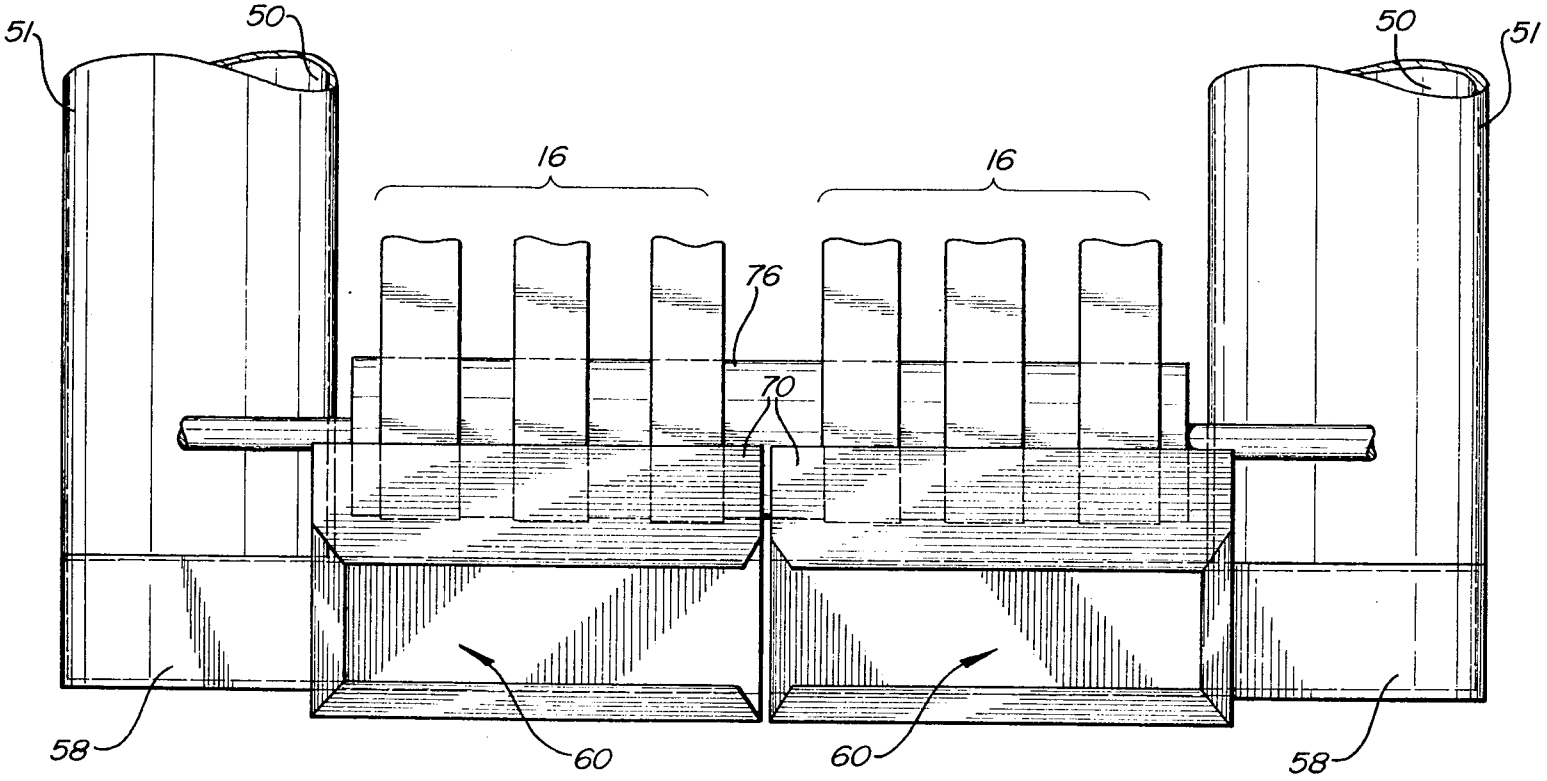
FIG. 4 is a view, taken generally along line 4—4 in FIG. 3.

In order to remove articles selectively from one or both of the vacuum belt conveyors, a vacuum means 48 is positioned between the inverter roll 18 and the first location 14. As seen in FIGS. 2–4, the vacuum means 48 comprises a pair of vacuum chambers 50 defined by tanks 51 to which a partial vacuum is supplied by a vacuum pump 52, a pair of suction lines 54 and a valve means 56 in each of the suction lines. The pump 52 is driven by motor 57. It will be appreciated that while only one suction line is depicted in FIG. 2 for the sake of clarity, separate lines 54, including separate valves 56, extend from the pump 52 to the two chambers 50.

A pair of generally upwardly extending chutes 58 define a pair of collection openings 60 which, as seen in FIG. 3, are positioned adjacent respective transport paths opposite the vacuum belt conveyors, including vacuum belts 15. Each of the collection openings 60 communicates with a respective one of the pair of vacuum chambers 50. The vacuum means 18 is supported by brackets 62 which are bolted to the side frames 10 and 10 and to members 64 attached to the bottom of the cylindrical tanks 51. Chutes 58 are also attached by members 66 to cross brace 68. Brace 68 may also be attached to additional supporting structure.

The chutes at their upper ends include a pair of guide plates 70, each of which extends from adjacent one of the collection openings 60 generally toward the first location 14, but inclined slightly downward. The guide plates 70 assist in the movement of bags toward the openings. Similarly, a series of fingers 80 are provided adjacent the gripping means 18 for aiding the movement of bags toward the gripping means 18 in those instances where the bags are not to be ingested through openings 60. The collection openings 60 extend substantially completely across the associated transport paths.

During operation, the partial vacuum supplied to the vacuum chambers 50 applies a force to the articles through the collection openings 60, which force exceeds the force applied to the articles by the pair of vacuum belt conveyers 15. When the valves 56 are opened to permit communication between the vacuum chambers 50 and the vacuum pump 52, bags carried by vacuum belts 15 reach the collection openings 60 and are simply stripped from the belts 15 and ingested into the chamber 50. By this arrangement, it is not required that the application of vacuum to the vacuum manifold 17 be terminated in order to remove the bags from the belts 15. Further, by opening only one of the valves 56, bags may be culled from one of the transport paths while bags in the other path are transported and handled in the normal fashion.

Having described the invention in detail and by reference to preferred embodiments thereof, it will be apparent that modifications and variations are possible without departing from the scope of the invention defined in the appended claims.

What is claimed is:

1. An article transport arrangement for conveying articles along a pair of generally parallel transport paths from a first location to a second location, comprising:

a pair of vacuum belt conveyors extending from said first location to said second location above said transport paths, inverter roll means, adjacent said transport paths at said second location, for receiving articles from said vacuum belt conveyors and stacking articles in two piles beneath said vacuum belt conveyors, and vacuum means, positioned between said inverter roll and said first location beneath said transport paths, for removing articles selectively from either or both of said vacuum belt conveyors, said vaccum means comprising, a pair of vacuum chambers to which a partial vacuum may be supplied, means defining a pair of collection openings positioned adjacent respective transport paths opposite said vacuum belt conveyors, each such collection opening communicating with a respective one of said pair of vacuum chambers, and means for supplying a partial vacuum to said vacuum chambers, whereby articles may be ingested through said openings into said chambers from said vacuum belt conveyors.

2. The article transport arrangement of claim 1 in which said partial vacuum supplied to said vacuum chambers applies a force to said articles through said collection openings in excess of the force applied to said articles by said pair of vacuum belt conveyors, whereby said articles are removed from said transport arrangement without altering operation of said vacuum belt conveyors.

3. The article transport arrengement of claim 1 in which said means defining a pair of collection openings comprises a pair of generally upwardly extending chutes, defining said collection openings at their upper ends and extending downward to said vacuum chambers.

4. The article transport arrangement of claim 3 in which said means defining a pair of collection openings further comprises a pair of guide plates, each extending from one of said collection openings generally toward said first location, whereby passage of said articles over said vacuum means is facilitated.

5. The article transport arrangement of claim 4 in which each of said guide plates is inclined downward from the edge of said collection opening.

6. The article transport arrangement of claim 1 in which each of said collection openings extends substantially completely across the transport path associated therewith.

7. An article transport arrangement for conveying articles along a pair of generally parallel transport paths from a first location to a second location, comprising:

a pair of vacuum belt conveyors extending along the transport paths from the first location to the second location, and vacuum means for applying a suction force to said articles in excess of that applied to said articles by said vacuum belt conveyors, so as to remove said articles selectively from either or both of said transport paths.

8. The article transport arrangement of claim 7 in which said vacuum means comprises:

a pair of vacuum chambers to which a partial vacuum may be supplied, means defining a pair of collection openings positioned adjacent respective transport paths opposite said vacuum belt conveyors, each such collection opening communicating with a respective one of said pair of vacuum chambers, and means for supplying a partial vacuum to said vacuum chambers, whereby articles may be ingested through said openings into said chambers from said vacuum belt conveyors.

9. The article transport arrangement of claim 7 in which said means for supplying a partial vacuum to said vacuum chambers comprises:

a partial vacuum source, a pair of suction lines, extending from said partial vacuum source to said pair of vacuum chambers, for supplying a partial vacuum thereto, and valve means in each of said suction lines, whereby said partial vacuum may be applied selectively to said pair of vacuum chambers so as to remove articles selectively from either or both of said vacuum belt conveyors.

* * * * *